United States Patent [19]

Hursh et al.

[11] Patent Number: 4,571,960

[45] Date of Patent: Feb. 25, 1986

[54] TWO-PLY ATHLETIC SOCK WITH LOW-FRICTION INTERFACE SURFACES

[75] Inventors: David F. Hursh, Lahaska, Pa.; Anthony de Irureta-Goyena, Burlington, N.C.

[73] Assignee: Foster-Boyd, Inc., Lahaska, Pa.

[21] Appl. No.: 431,766

[22] Filed: Sep. 30, 1982

[51] Int. Cl.[4] ..... D04B 7/04

[52] U.S. Cl. ..... 66/196; 66/178 R; 2/239

[58] Field of Search ..... 66/178, 185, 186, 187, 66/194, 202; 57/210, 227, 225; 2/239

[56] References Cited

U.S. PATENT DOCUMENTS

| | | | |
|---|---|---|---|
| 1,434,941 | 11/1922 | Boyd | 66/178 X |
| 3,250,095 | 5/1966 | Bird | 66/178 |
| 3,259,915 | 7/1966 | Dison | 2/238 |
| 3,796,067 | 3/1974 | East | 66/178 |
| 4,341,096 | 7/1982 | Safrit et al. | 66/178 |

FOREIGN PATENT DOCUMENTS

| | | | |
|---|---|---|---|
| 2454766 | 12/1980 | France | 66/178 |

OTHER PUBLICATIONS

Wignall, Hosiery Technology, Nat. K & I Outer Wear Assoc., 1968, N.Y., p. 63.

*Primary Examiner*—Ronald Feldbaum
*Attorney, Agent, or Firm*—Paul & Paul

[57] ABSTRACT

The sock has at least a foot portion consisting of a first inner layer or ply disposed within and attached to a second outer layer or ply. The first or inner ply has (a) an inner (next-to-the-foot) surface comprising a plurality of moisture-absorbing fibers such as cotton fibers around which a yarn such as a nylon yarn is spirally wound and also has (b) an outer surface comprising yarns of nylon, for example, having relatively low friction characteristics compared with said inner surface. The second or outer ply, has (a) an inner surface comprising yarns of nylon, for example, which also have relatively low friction characteristics and (b) an outer surface plaited on the yarns of the inner surface comprising a plurality of moisture-absorbing fibers such as cotton around which a yarn such as nylon is spirally wound. The interface between the surfaces, having relatively low friction characteristics, permits the inner ply (in use) to slide relative to the outer ply for greater foot comfort and avoidance of blisters.

1 Claim, 6 Drawing Figures

TWO-PLY ATHLETIC SOCK WITH LOW-FRICTION INTERFACE SURFACES

BACKGROUND OF THE INVENTION

A. Field of the Invention

This invention relates to socks in general and in particular, to a two-ply sock of improved durability, comfort, and low friction inter-ply construction for athletic activity such as jogging.

B. Prior Art

Especially since the advent of the jogging craze, there has been increasing interest in the development of socks for joggers or athletes which are more comfortable and which are intended to reduce the physical toll upon the feet and legs of the jogger or athlete. For this purpose, various types of socks have been sold or patented which are supposed to offer superior comfort, greater foot ease, greater shock absorbency, moisture absorption, and other advantages.

One such patent, U.S. Pat. No. 3,250,095 to Bird teaches a single-ply sock with terry loops of hydrophilic yarn on its inner surface and hydrophobic and elastic yarns on its outside surface. The avowed purpose of this construction is to wick perspiration away from the skin of the wearer and to provide good thermal insulating qualities by the use of the inside terry loops. Bird asserts that this construction prevents the yarn from the matting or packing down during use of conventional socks which reduces or destroys the thermal insulating and softness characteristics which are desirable in such socks.

U.S. Pat. No. 3,796,067 issued to East is a two-ply sock with terry loops on both the inner and outer surfaces for greater comfort, warmth and durability.

Other double-ply athletic socks are available commercially, but they are bulky and tend to bunch up thereby causing abrasion, blisters and other discomfort.

A different jogging sock is made of two layers of pure silk which makes it extremely costly and difficult to launder. Also, since silk has low friction characteristics, the inner layer is more likely to slide down the foot. Also, the outer layer tends to move relative to the inside surface of the shoe with which it makes contact.

Still another sock is made of pima cotton which, while it may be comfortable, is not very durable.

In U.S. application Ser. No. 234,171, filed Feb. 13, 1981 by Hursh, et al entitled "Two-Ply Athletic Sock" and in U.S. application Ser. No. 363,124, filed on Mar. 29, 1982 entitled "Anti-Friction Two-Ply Athletic Sock" by Hursh and Johnston, athletic socks are described and claimed which are of two-ply construction. The outer surface of the inner layer and the inner surface of the outer layer have relatively low friction characteristics whereas the inner surface of the inner layer next to the skin and the outer surface of the outer layer next to the interior surface of the shoe have relatively high friction characteristics. While these latter types of constructions are highly satisfactory, their basic concept has been extended and improved in the present invention.

It is among the objects of the present invention to provide:

1. An athletic sock of the double-ply type wherein the surface of each ply is tailored to the particular function it is expected to perform.

2. An athletic sock which gives the wearer a feeling of great foot ease.

3. An athletic sock in which the interface of the two layers has low-friction characteristics thereby tending to reduce the occurrence of blisters.

4. An athletic sock which has a good "hand" and resists "pilling".

5. An athletic sock which has improved anti-abrasion characteristics.

6. Other advantages and functions which will be apparent to the reader of this specification.

SUMMARY OF THE INVENTION

A sock comprising a double-ply foot portion which includes a first, inner ply having an inner surface which comprises a plurality of substantially untwisted fibers around which a yarn is spirally wound and an outer surface comprising yarns having relatively low friction characteristics. The outer ply within which said first ply is disposed has an inner surface comprising yarns having relatively low friction characteristics and an outer surface comprising a plurality of substantially untwisted fibers around which a yarn is spirally wound.

In another embodiment, the fibers of the inner surface of the inner ply and the outer surface of the outer ply around which a yarn is spirally wound may comprise a plurality of hydrophilic yarns having a predetermined twist characteristic.

DETAILED DESCRIPTION OF THE DRAWINGS

Figure 1:
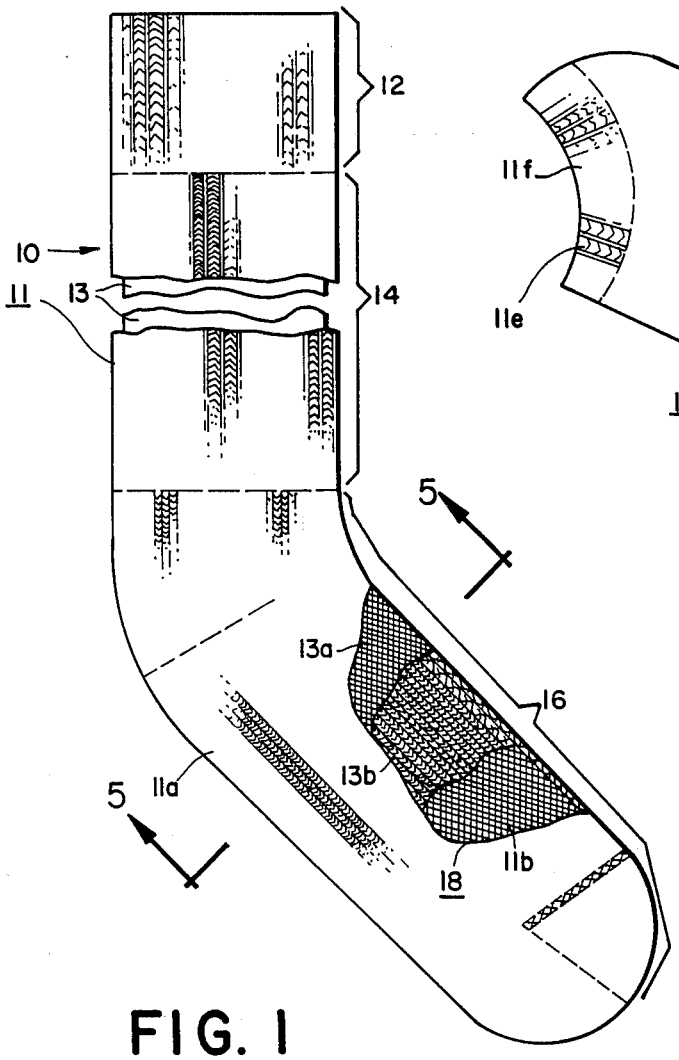
FIG. 1 is a side elevation view of the final composite sock having several cut-out and partially sectional portions which show the internal construction.

Referring to FIG. 1, there is shown at the numeral 10 a sock made in accordance with the present invention. It is of the two-ply type having an outer ply 11 which has a cuff portion 12, a lower leg portion generally at the numeral 14 and a foot portion indicated generally at 16. Its inner ply 13 has a generally congruous shape except that its foot portion is slightly shorter to prevent bunching when a foot is in it and when it is in the shoe. If desired, the cuff portion 12 of the outer layer 11 may be dyed a different color than the rest of the sock for enhancing its outward appearance. In FIG. 1, the cuff portion 12 of the outer layer is knitted of predyed stretch nylon with a Spandex yarn in a rib stitch. The lower leg portion 14 of the outer layer is also knitted in a rib stitch and its outer surface is knitted of "Wonderspun" (a trademark of the Q.T. Hosiery Sales Corp. of Graham, N.C.) cotton yarns that have been plated on inner yarns of texturized stretch nylon. The corresponding leg portion of the inner layer 13 is knitted in a jersey stitch with its outer surface comprising texturized stretch nylon yarns and its inner surface comprising Wonderspun cotton yarns that have been plated on the stretch nylon yarns.

The foot portion 16 has its outer ply made of the same yarns as those in the portion 14, but knit in a jersey stitch. The broken-away portion 18 shows the outer surface 13*a* of the inner ply 13 as being made of texturized stretch nylon yarns. Its other surface 13*b* comprises Wonderspun cotton yarns which have been plated onto the texturized stretch nylon yarns of surface 13*a*. At 11*b* there is shown the inner surface of the outer layer 11 which is made of texturized stretch nylon yarns. The outer surface 11*a* of the outer layer comprises Wonderspun cotton yarns plated onto the texturized stretch nylon yarns which comprise inner surface 11*b*.

In order to make the sock 10, a special method was used which will now be explained.

Figure 2:
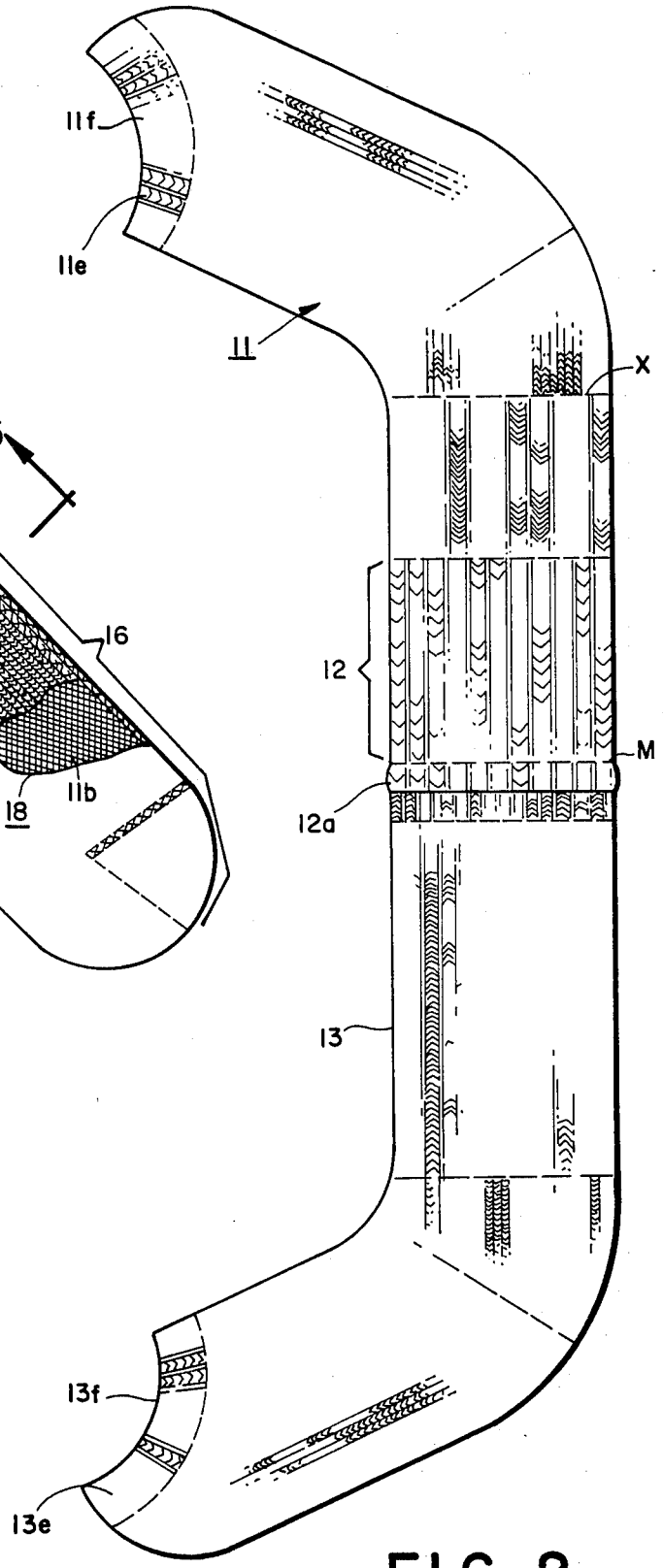
FIG. 2 is a substantially schematic view of the sock blank according to the present invention after its first pass through a knitting machine.

FIG. 2 shows how the sock blank appears after being knitted in a single pass through a knitting machine which may be, for example, of the two-cylinder, 132 needle, "KOMET" type. The sock blank 10 has a top, outer sock ply 11 (down to line M) and a bottom, inner sock ply 13 (below line M). Outer ply 11 is first knitted reciprocatingly in the toe portion, the heel portion, then the lower leg and cuff portions to the line "M". At that point, knitting continues on the portions of the inner ply 13 located opposite the cuff portion 12, the leg portion 14, performing the heel and then the toe reciprocations to end finally at the clip. Each foot portion has a clip 11*e* or 13*e* and a toe opening 11*f* or 13*f*, respectively.

Although the construction of the foot portion of the composite sock is of primary interest, details of the entire method of making the composite sock will now be explained. First, the foot portion of the outer ply 11 is knit with reciprocated toes and heels with half of the needles functioning in each direction. Throughout the foot portion and both heel and toe reciprocations, the machine knits a jersey stitch fabric having Wonderspun cotton yarns on the outside plated over texturized nylon yarns. There are in the Wonderspun yarns, on one illustrative case, 18 singles cotton around which seven continuous filaments of 20 denier nylon are spirally wound at 10–24 wraps per inch. The texturized nylon yarns plated on the other surface are, in one illustrative case, of two-ply, 70 denier, 34 filament construction. The machine continues to knit the same jersey stitch for the balance of the foot portion until it reaches line "X". At this point, the machine is programmed so as to change to a rib stitch made of the same material. This rib stitch continues for a distance depending upon whether the sock is of the anklet, crew, or over-the-calf type.

When it reaches the cuff portion 12, which may be of a different color if desired, the machine may continue plating to the top or is programmed to begin to knit a pre-dyed, two-ply, 100 denier stretch nylon with a rib stitch. It continues this stitch until it reaches the midpoint of the blank at the letter "M" whereupon it continues to knit a few more courses in the same fashion to form a welt 12*a* over the top of the cuff and continues for a few more courses into the beginning courses of the inner sock 13.

At line S, the machine is programmed to continue to knit the balance of inner ply 13 in the opposite way, i.e., first the leg portion and then the foot portion of inner ply 13. These portions are knit of the same material as the foot portion of the (upper) outer ply sock 11, namely, Wonderspun (18 singles) cotton, nylon wrapped, plated over 2-ply, 70 denier, 34 filament stretch nylon, but in a jersey stitch. In the blank as shown, the outer surface of the inner ply has high friction characteristics relative to its inner surface. The knitting continues until the toe clip portion 13*e* and its opening 13*f* are knit.

Figure 3:
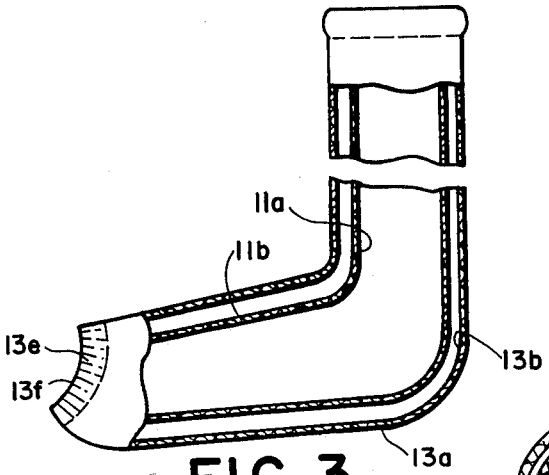
FIG. 3 is a schematic view of the sock shown in FIG. 1 after its upper portion has been pulled downward into the lower portion of the blank.
Figure 5:
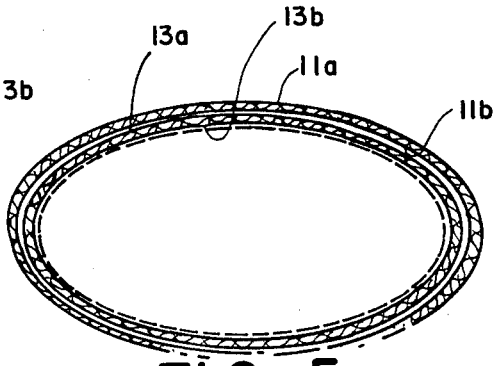
FIG. 5 is a sectional view of the sock as shown in FIG. 1 as it would appear in a sectional view taken along the section lines 5—5 thereof.

After the sock blank as shown in FIG. 1 which depicts it after the first pass through the knitting machine has been formed, the upper, outer ply 11, which is slightly longer than the lower ply 13, is drawn through lower ply 13 by reaching through the open toe portion 13*e* of the lower sock, grasping the open toe portion 11*e* of the upper or outer sock and pulling the upper sock through the lower sock until the foot portions are congruent and the open toe portions 11*e* and 13*e* are located in approximately the same place. When this is done, the sock will have the general configuration as shown schematically in FIG. 3. The top openings 11*e* and 13*e* are then closed by stitching 11*e* and 13*e* together. Then, in order that the seams will be on the inside of the finished composite sock, the sock as shown in FIG. 3 is turned inside out to form the completed sock shown in FIG. 1.

Figure 6:
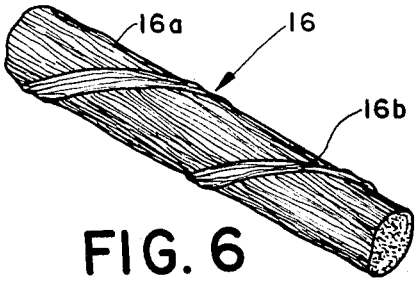
FIG. 6 is an enlarged perspective view of one of the yarns used in making the foot portions of the composite sock shown in FIG. 1.
Figure 4:
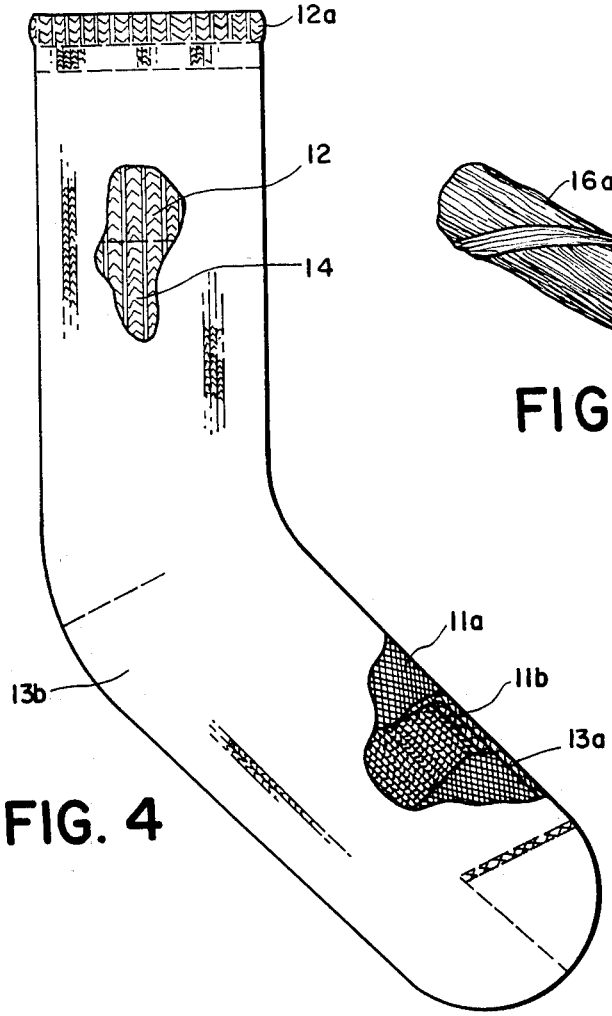
FIG. 4 is a side elevation view of the composite sock shown in FIG. 3 after it has been turned inside out and sewn, its inner construction being shown by cut-away portions.

The finished composite sock 10 in the foot portion has a surface which contacts the skin, namely, surface 13*b* of the inner ply which is hydrophilic being principally made of the Wonderspun yarns 16*a* (FIG. 6). Thus, perspiration is drawn into those yarns at that surface and part is believed to be transferred to the outer surface 13*a* of the inner ply by virtue of the wicking action of the nylon yarns 16 (FIG. 6) spirally wound around the untwisted cotton yarns. Since the inner surface of the inner ply has a relatively high frictional coefficient, that ply will tend to stay in place against the foot. Moisture from the inner surface 13*b* is also transmitted outwardly by the relatively hydrophobic nylon stretch yarns plated on outer surface 13*a* which has a relatively low coefficient of friction. Moisture on surface 13*a* is transmitted to the inner surface 11*b* of the outer layer by the wicking action of the nylon yarns. Surface 11*b* is made in substantially the same way as the outer surface of the inner layer. The two facing texturized nylon surfaces 13*b*, 11*b* therefore tend to transmit moisture gathered on the inner surface of the inner layer to the outer surface 11*a* of the outer layer by the wicking action of those two nylon surfaces. Since the outer surface 11*a* also contains moisture-transferring nylon yarns spirally wound around hydrophilic natural cotton yarns, the latter will tend to absorb moisture transferred from the inner surface of the outer layer. The two facing stretch nylon surfaces 13*b*, 11*b*, having low coefficients of friction, and being substantially unconnected except at the toe seam, are free to slide relative to one another. This permits the foot portion of the inner ply to slide relative to the foot portion of the outer layer thereby preventing blisters at points on the sole, heel, toe or elsewhere on the foot where they are otherwise likely to occur.

The type of yarns used on the inner surface of the inner ply and on the outer surface of the outer ply as taught above form surfaces having high "anti-pilling" characteristics, high abrasion resistance, great covering power, a soft "hand" or feel, and may be produced at very high speeds without the concomitant production of large amounts of lint or dust.

The inner surface of the inner ply and the outer surface of the outer ply may be formed by using other than substantially untwisted cotton fibers around which nylon yarns are spirally wound. Instead of cotton, wool or wool/acrylic mixtures, a new sponge-like acrylic such as Bayer's "Dunova" or rayon could be used. Similarly, instead of using nylon as the spiral winding, other appropriate high abrasion-resistant material may be used, particularly if it is also hydrophobic.

While Wonderspun yarns with untwisted cores have been found to produce highly satisfactory results, their cores may alternatively comprise filaments or other components which have a predetermined degree of twist. Such cores would also be generally hydrophilic and have a spiral wrap as in the case of the untwisted filaments.

We claim:

1. A knitted sock comprising:

(a) an outer layer having a cuff portion, a lower leg portion and a foot portion, said foot portion having an outer shoe-engageable surface comprised of a plurality of hydrophilic, substantially untwisted yarns around which a yarn of hydrophobic material is spirally wound, and also having an inner interfacing surface comprising a plurality of yarns having frictional characteristics substantially lower than said outer surface of said outer ply and being made of generally hydrophobic textile material, and (b) an inner layer with an outside surface interfacing with said inner surface of said outer layer and comprising a plurality of yarns which have frictional characteristics substantially lower than said inner surface of said inner ply and are generally hydrophobic and an inner foot-engageable surface comprised of a plurality of substantially untwisted hydrophilic yarns around which a yarn of hydrophobic material yarn is spirally wound.

* * * * *